US006094748A

United States Patent [19]

Kindler

[11] Patent Number: 6,094,748

[45] **Date of Patent: *Aug. 1, 2000**

[54] PUNCTURE-RESISTANT GLOVES

[76] Inventor: Bruce R. Kindler, 6413 Palomino Way, West Linn, Oreg. 97068-2244

[ * ] Notice: This patent is subject to a terminal disclaimer.

[21] Appl. No.: 09/282,756

[22] Filed: Mar. 31, 1999

Related U.S. Application Data

[63] Continuation-in-part of application No. 09/234,625, Jan. 21, 1999.

[51] Int. Cl.[7] ..... A41D 19/00

[52] U.S. Cl. ..... 2/167; 2/16; 2/161.6; 2/169

[58] Field of Search ..... 2/16, 159, 161.6, 2/161.7, 161.8, 163, 167, 169

[56] References Cited

U.S. PATENT DOCUMENTS

| | | | |
|---|---|---|---|
| 3,961,377 | 6/1976 | Lars-Jos | 2/169 |
| 4,042,977 | 8/1977 | Antonious | 2/161 |
| 4,384,449 | 5/1983 | Byrnes, Sr. et al. | 57/210 |
| 4,742,578 | 5/1988 | Seid | 2/2.5 |
| 5,087,499 | 2/1992 | Sullivan | 428/85 |
| 5,119,512 | 6/1992 | Dunbar et al. | 2/167 |
| 5,224,363 | 7/1993 | Sutton | 66/202 |
| 5,231,700 | 8/1993 | Cutshall | 2/161.7 |
| 5,423,090 | 6/1995 | Gimbel | 2/161.7 |
| 5,564,127 | 10/1996 | Manne | 2/161.7 |
| 5,565,264 | 10/1996 | Howland | 428/229 |
| 5,568,657 | 10/1996 | Cordova et al. | 2/167 |
| 5,685,014 | 11/1997 | Dapsalmon | 2/16 |
| 5,822,791 | 10/1998 | Baris | 2/2.5 |
| 5,853,885 | 12/1998 | Prickett | 428/401 |

OTHER PUBLICATIONS

Consumer Catalog from Hammacher Schlemmer, Gift 1998, p. 29.

Product Brochure from Warwick Mills, Inc. for Turtleskin puncture–resistant material.

*Primary Examiner*—Katherine Moran

*Attorney, Agent, or Firm*—Davis Wright Tremaine LLP

[57] ABSTRACT

The present invention provides a puncture-resistant glove for protecting a hand comprising a palmar side and a dorsal side. The glove comprises a palmar portion designed to fit over the palmar side of the hand, the palmar portion being made of a puncture-resistant material comprising a plurality of layers of tightly woven base fabric having a density in excess of 80 threads per inch in at least the warp and fill directions and having warp yarn cover of at least 100% at the fill pick. The glove also comprises a dorsal portion designed to fit over at least part of the dorsal side of the hand, the dorsal portion being sewn to the palmar portion along seams located on a dorsal side of the glove.

15 Claims, 4 Drawing Sheets

PUNCTURE-RESISTANT GLOVES

CROSS-REFERENCE TO RELATED APPLICATIONS

This application is a continuation-in-part of, and claims priority from, U.S. patent application Ser. No. 09/234,625 filed Jan. 21, 1999.

FIELD OF THE INVENTION

The present invention provides puncture-resistant gloves. Specifically, the gloves are useful for wearers facing a risk of needle puncture, especially when there is a risk or probability of contaminated needles.

BACKGROUND OF THE INVENTION

Gloves come in many varieties, each designed to protect a person's hand from some sort of hazard without overly impairing the person's manual dexterity. For example, insulated ski gloves protect a skier's hands from moisture and low temperatures while allowing the skier to grip ski poles. Latex gloves protect doctors and other health care providers from external contamination while allowing them to handle small, delicate surgical tools, and also prevent the patient from being contaminated by microorganisms on the hands of the health care provider. Leather gloves protect a person's hand from abrasion, thorns and heavy loading while allowing the person to grip and move heavy or rough-surfaced items. Finally, chain-mail gloves protect a person's hand from being cut by knives.

Gloves usually are a compromise between adequate protection and manual dexterity. A glove's design and the material from which it is built determine the glove's characteristics. Thus, a large glove built with heavy materials provides a lot of protection but impairs manual dexterity. Examples of this type of glove include ski gloves, which tend to be large and are made of several layers including a liner, and insulation layer, and an outer shell, and leather work gloves, which are large and made with thick, heavy leather to provide much protection. In contrast to a large and heavy glove, a small, tight-fitting glove made with thin, lightweight materials provides less physical protection but more manual dexterity. For example, surgeon's gloves are tight-fitting and made with thin, lightweight materials such as latex. The surgeon's glove allows much manual dexterity but acts only as a barrier against contaminated fluids and contaminated contact surfaces. The glove's thin construction does not permit it to provide much protection against such mechanical hazards as piercing or cutting with surgical instruments.

While existing gloves protect the hands from a number of environmental conditions, none effectively provide puncture resistance, especially from contaminated needles, without impairing manual dexterity; gloves that do provide puncture-resistance tend to be thick, heavy and awkward. There is thus a need for a lightweight and relatively thin puncture-resistant glove.

SUMMARY OF THE INVENTION

The present invention provides a puncture-resistant glove for protecting a hand comprising a palmar side and a dorsal side. The glove comprises a palmar portion designed to fit over the palmar side of the hand, the palmar portion being made of a puncture-resistant material comprising a plurality of layers of tightly woven base fabric having a density in excess of 80 threads per inch in at least the warp and fill directions and having warp yarn cover of at least 100% at the fill pick. The glove also comprises a dorsal portion designed to fit over at least part of the dorsal side of the hand, the dorsal portion being sewn to the palmar portion along seams.

DETAILED DESCRIPTION OF THE INVENTION

Described below are two embodiments of the present puncture-resistant glove. The embodiments illustrate ways in which the present puncture-resistant glove may be implemented. In the description that follows, like numerals represent like elements in all figures. For example, if the numeral 10 is used in one figure to refer to a specific element or step, the numeral 10 appearing in any other figure refers to the same element.

First Embodiment

Figure 1:
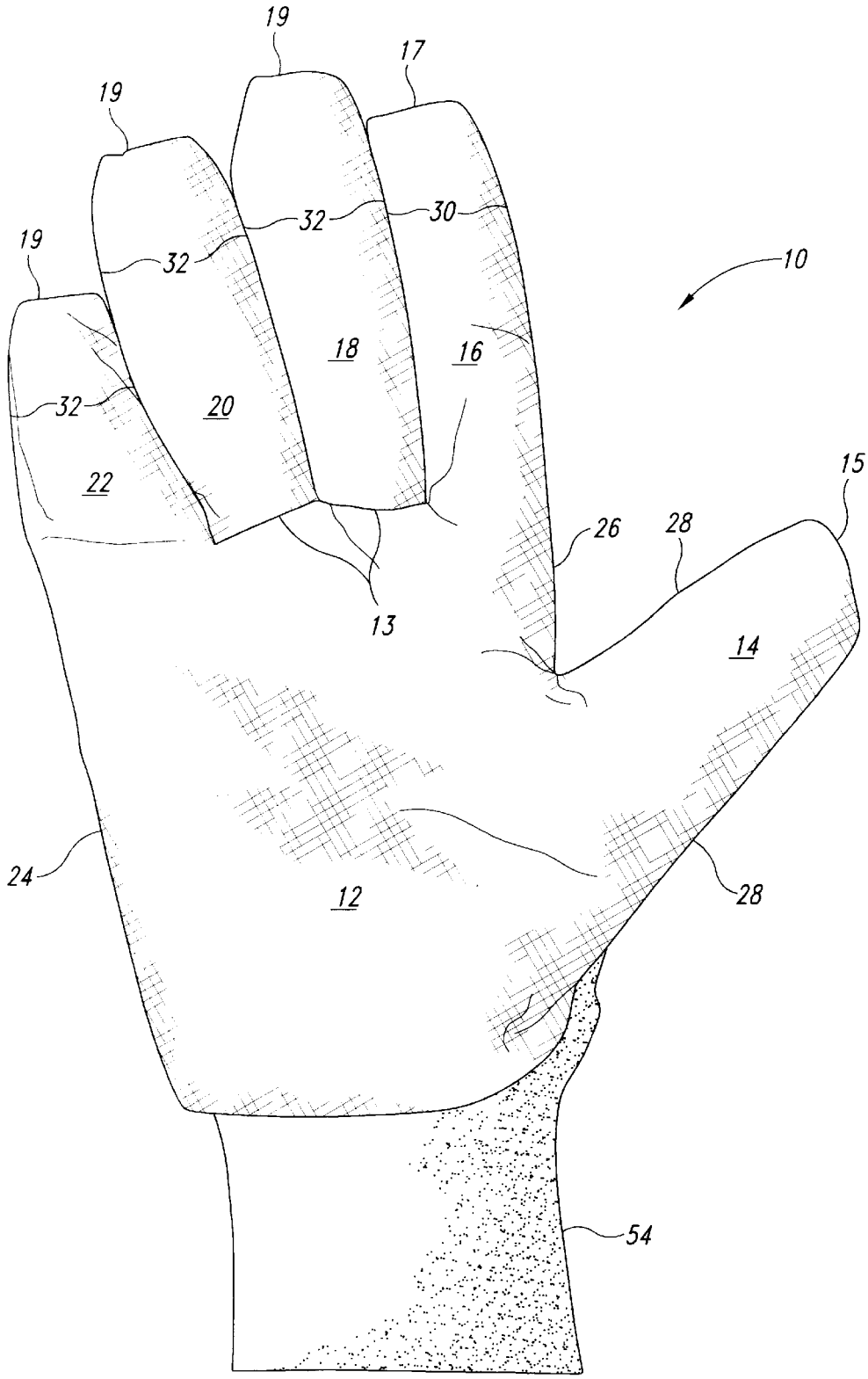
FIG. 1 is a plan view of a palmar side of a first embodiment of the inventive puncture-resistant glove showing the puncture-resistant material in a lighter shade, and the stretchable elastic material as a dark shade. The figure illustrates a right-hand glove.

FIG. 1 illustrates a palmar side 10 of a first embodiment of a puncture-resistant glove. The palmar portion covers the entire palmar side of a hand, and includes a palm 12, a thumb 14, an index finger 16, a middle finger 18, a ring finger 20, and a little finger 22. The middle finger 18 and ring finger 20 are connected to palm 12 along seam 13, while the thumb 14, index finger 16 and little finger 22 are integrally attached to the palm 12 with the same piece of puncture resistant material. The palmar portion of the glove offers additional protection to the hand by wrapping around the sides of the hand, fingers and finger tips to the dorsal side of the glove. Thus, the palmar portion wraps around the lateral side 24 and the contra-lateral side 26 of the hand, the sides 28 of the thumb, the sides 30 of the index finger, and the sides 32 of the middle finger 18, the ring finger 20 and the little finger 22. In addition, the palmar portion wraps around the tip 15 of the thumb, the tip 17 of the index finger, and the tips 19 of the middle, ring and little fingers.

By wrapping the palmar portion of the glove around the lateral side 24 and contra-lateral side 26 of the hand, and around the sides 28, 30 and 32 and tips 15, 17 and 19 of each finger, most seams on the glove are positioned on the dorsal side of the glove. Minimizing the number of seams on the palmar side of the glove increases the glove's puncture protection, because the seams are structural weak points where a sharp object could penetrate.

The palmar portion of the glove is made using the puncture-resistant fabric disclosed in U.S. Pat. No. 5,565, 264, whose disclosure is incorporated by reference herein. A preferred puncture-resistant material is sold under the trademark TURTLESKIN by Warwick Mills, Inc., of New Ipswich, N.H. The puncture-resistant material is formed from a plurality of layered, densely woven fabrics, each formed by tightly weaving multi-filament yarns to obtain a warp yarn "density" or "cover" in excess of 100 percent at the center of the fill yarn. Further, the fill yarn density or cover is preferably also in excess of 75 percent as measured between two warp ends. Fibers which have been found especially suitable for the warp yarn are the para-aramids (e.g., Kevlar®); high density polyethylenes (e.g., Spectra®); and liquid crystal polymers (e.g., Vectran®).

The number of layers of basic fabric used in the puncture-resistant material depends on the hazards against which the wearer of the glove is to be protected. For example, protection against penetration by thin instruments such as awls or hypodermic needles is extremely difficult. Yet when the fabric and construction of the present puncture-resistant material, 20 layers of a 110×67 weave of density 200×400 denier resisted penetration forces up to 1.6 inch pounds as applied with an ice pick of 0.163 inch diameter. When 54 layers of basic fabric were stacked together, the resultant composite resisted penetration up to an applied awl force in excess of 400 inch pounds.

The dense construction of the fabric layers in the puncture-resistant fabric restricts inplane motion. This requires increased out of plane extrusion for any significant penetration. The out of plane extrusion forces significantly accumulate over excessive layers to the extent that further penetration requires breakage of large numbers of high modulus, high breaking strength fibers before further penetration can be achieved. This not only limits penetration by thin, sharp instruments such as awls, picks, and hypodermic needles, but also increases protection against sharp-edged instruments, such as knives, which must first penetrate before they can cut.

Figure 2:
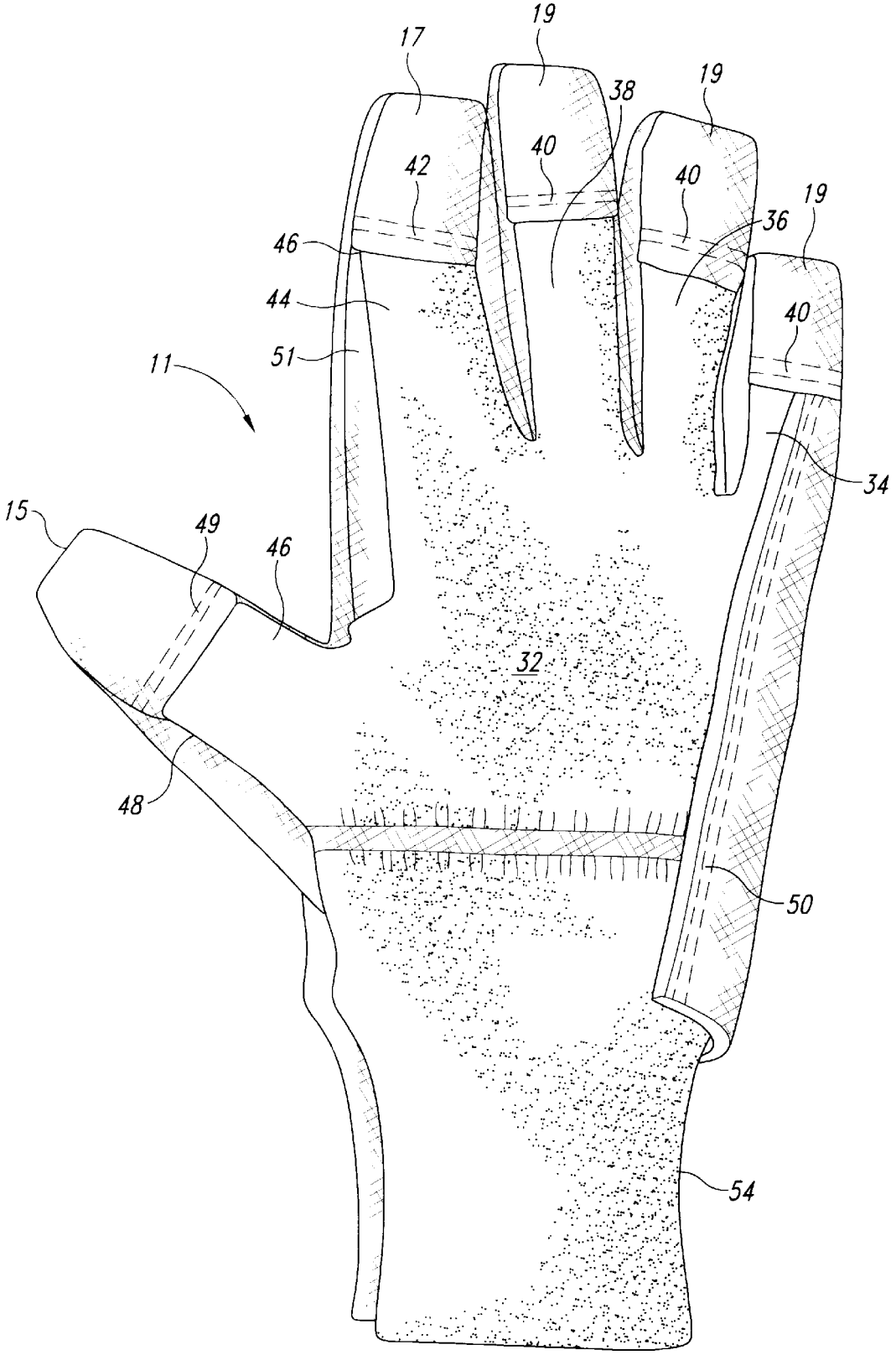
FIG. 2 is a plan view of a dorsal side of the first embodiment of the inventive puncture-resistant glove showing the seams and areas of puncture-resistant material (lighter shade) and stretchable elastic material (darker shade). The seams joining the puncture-resistant material to the stretchable material are shown. The figure illustrates a right-hand glove.

FIG. 2 illustrates the dorsal side 11 of the first embodiment of the puncture-resistant glove. The dorsal side 11 of the glove 10 consists primarily of a dorsal portion 32 that includes a little finger portion 34, a ring finger portion 36, a middle finger portion 38, an index finger portion 44 and a thumb portion 46. The dorsal portion is sewn to the palmar portion along finger tip seams 40, 42 and 49, thumb seam 48, lateral seam 50 and contra-lateral seam 51, all of which are positioned on the dorsal side of the glove. At finger tip seams 40, 42 and 49 the palmar portions wrapped around the fingertips 19, 17 and 15 are sewn to the little finger portion 34, the ring finger portion 36, the middle finger portion 38, the index finger portion 44 and the thumb portion 46. The palmar portion also wraps around the lateral and contra-lateral sides of the hand and is sewn to the dorsal portion 32 along the lateral seam 50 and the contra-lateral seam 51. The palmar portion wraps around the side of the thumb 14 and is sewn to the dorsal portion along the thumb seam 48.

Dorsal portion 32 is provided with additional features that improve the fit of the glove. For example, a shirred elastic band (not shown) can be sewn transversely into the dorsal portion 32 to provide a snug fit on the hand. In addition, an elastic bit wrist 54 is sewn to both the dorsal portion 32 and the palm 12, allowing the glove to fit properly on the wrist and hand of the user. The dorsal portion is preferably made using a one-way stretch material.

The puncture-resistant glove 10 is manufactured using tools known in the art. The first step is to make patterns for both the palmar and dorsal portions of the glove. The pattern for the palmar portion takes into account the wrapping of the palmar portion around the sides of the hand, the sides of each finger, and the tips of each finger. Next, the palmar and dorsal portions are cut from their respective materials, and the dorsal portion is prepared for sewing by inserting the shirred elastic (not shown) and sewing it to the dorsal portion 32 using a Zig Zag sewing machine.

Having patterned and cut the palmar and dorsal portions, the next step is to sew the glove together. Although the material used on the palmar portion is puncture-resistant, it can be sewn. Most of the sewing is done using a standard No. 18 needle, which is normally used for sewing heavy, thick leather products. The force exerted on the needle by a sewing machine is much greater than the force the glove would have to withstand under normal conditions. All the sewing is done using nylon thread.

The first sewing step is to sew the palmar portion together along seam 13 and to sew the palmar portion to the dorsal portion along seams 40, 44, and 48 using a specialized PIQUE sewing machine. The PIQUE sewing machine allows sewing in the very limited space along these seams. Next, the glove component are turned inside out and transferred to a standard sewing machine, where seams 42, 48 and 50 are sewn using a standard sewing machine. The glove is turned right-side-out again and the elastic wrist 54 is sewn onto the palm 12 and dorsal portions 32 using a normal overlock sewing machine. The glove is completed by transferring all components back to the PIQUE machine to sew the seam 50 on the lateral side 24 of the glove between the wrist and the little finger.

Second Embodiment

Figure 3:
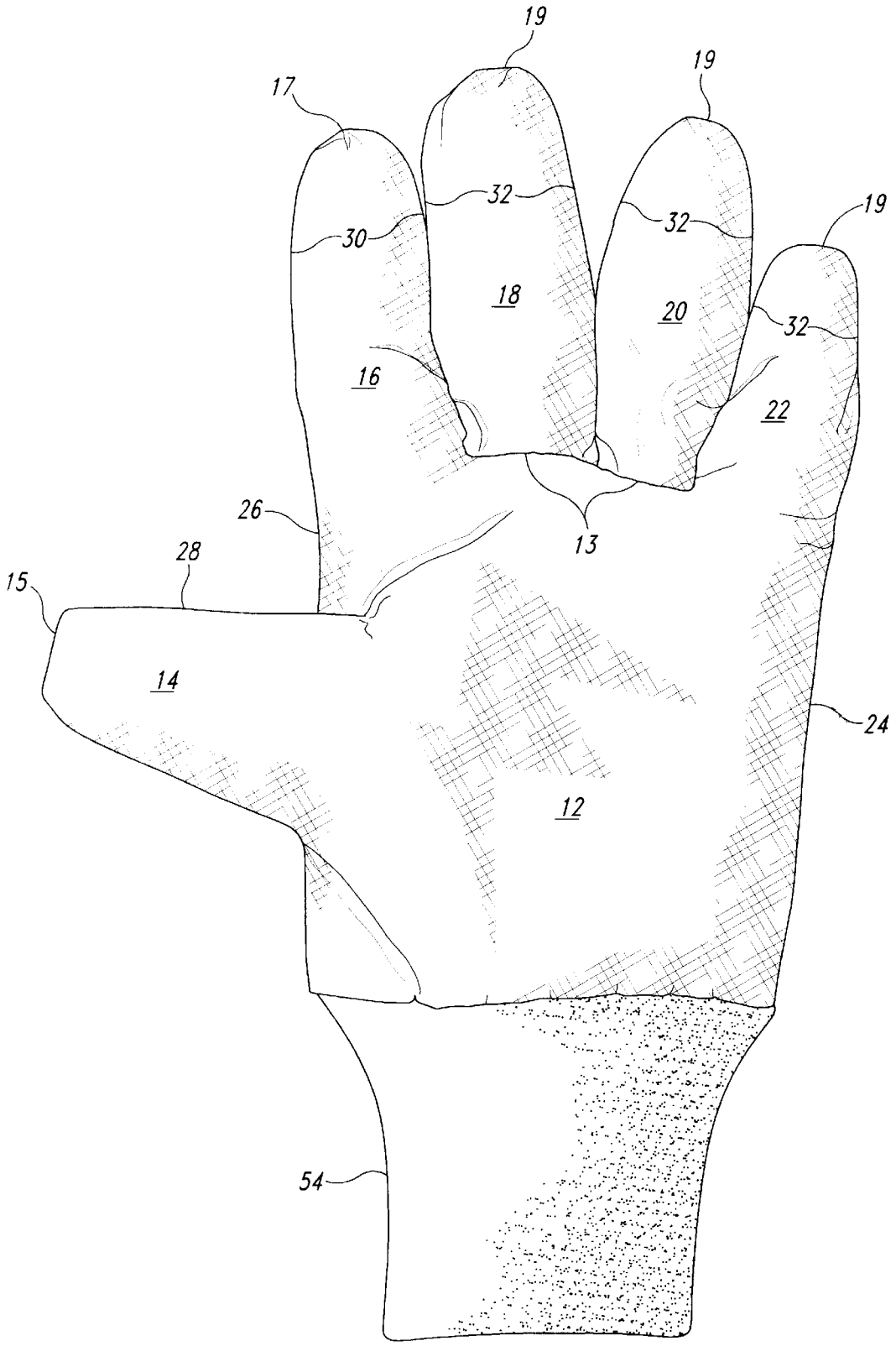
FIG. 3 is a plan view of a palmar side of a second embodiment of the inventive puncture-resistant glove. The figure illustrates a left-hand glove.

FIG. 3 illustrates a palmar side of a second embodiment of the puncture-resistant gloves. As in the first embodiment, the palmar portion of the second embodiment covers the entire palmar side of a hand, and includes a palm 12, a thumb 14, an index finger 16, a middle finger 18, a ring finger 20, and a little finger 22. The middle finger 18 and ring finger 20 are connected to palm 12 along seam 13, while the thumb 14, index finger 16 and little finger 22 are integrally attached to the palm 12 with the same piece of puncture resistant material. The palmar portion of the glove offers additional protection to the hand by wrapping around the sides of the hand, fingers and finger tips to the dorsal side of the glove. Thus, the palmar portion wraps around the lateral side 24 and contra-lateral side 26 of the hand, the sides 28 of the thumb, the sides 30 of the index finger, and the sides 32 of the middle finger 18, the ring finger 20 and the little finger 22. In addition, the palmar portion wraps around the tip 15 of the thumb, the tip 17 of the index finger, and the tips 19 of the middle, ring and little fingers. The palmar portion is made with the same puncture-resistant material as the palmar portion of the first embodiment.

Figure 4:
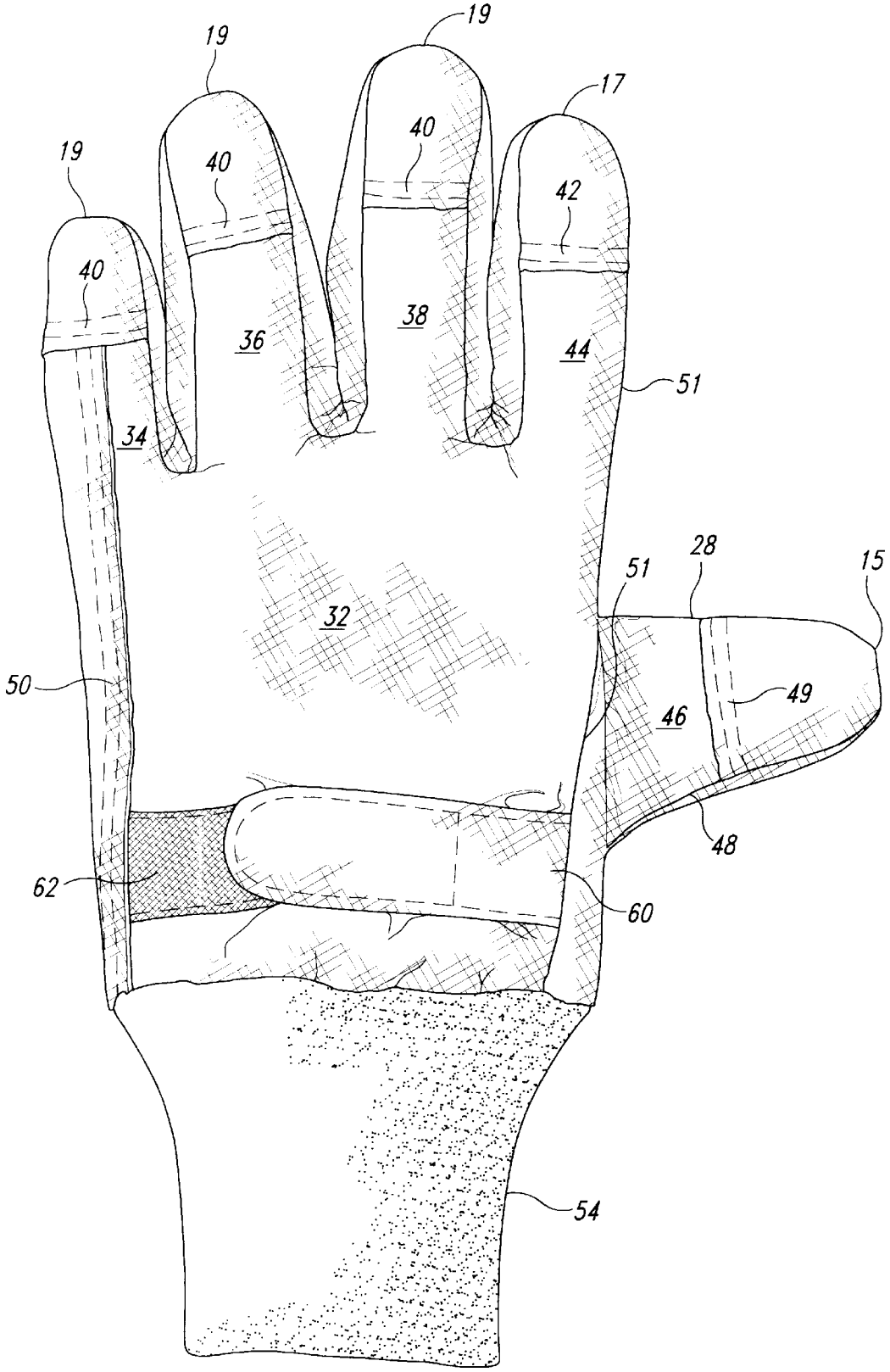
FIG. 4 is a plan view of a dorsal side of the second embodiment of the inventive puncture-resistant glove. The seams joining the puncture-resistant material to the stretchable material are shown. The figure illustrates a left-hand glove.

FIG. 4 illustrates the dorsal side of the second embodiment of the puncture-resistant glove. As with the first embodiment, the dorsal side of the glove 10 consists primarily of a dorsal portion 32 which includes a little finger portion 34, a ring finger portion 36, a middle finger portion 38, an index finger portion 44 and a separate thumb portion 46 sewn to the dorsal portion 32 along seam 51. The dorsal portion is sewn to the palmar portion along the finger tip seams 40, 42 and 49, the thumb seam 48, the lateral seam 50 and the contra-lateral seam 51, all of which are positioned on the dorsal side of the glove. At finger tip seams 40, 42 and 49, the palmar portions are wrapped around the fingertips 19, 17 and 15 and are sewn to the little finger portion 34, the ring finger portion 36, the middle finger portion 38, the index finger portion 44 and the thumb portion 46. The palmar portion also wraps around the lateral and contra-lateral sides of the hand and is sewn to the dorsal portion 32 along the lateral seam 50 and the contra-lateral seam 51. The palmar portion wraps around the side of the thumb 14 and is sewn to the dorsal portion along the thumb seam 48.

The primary difference between the dorsal side of the second embodiment and the dorsal side of the first embodiment is the material from which the dorsal side is made. In the first embodiment, the dorsal portion 32 is made of a stretchable material, which does not provide puncture protection; in the second embodiment the dorsal portion 32 is made of a puncture-resistant material. The second embodiment thus protects both the palmar and dorsal sides of the hand from puncture wounds. An additional feature of the second embodiment is the addition of a strap 60 across the dorsal side of the glove to permit the user to adjust the glove's fit. The strap serves the same function as the shirred elastic of the first embodiment. The strap is sewn onto the dorsal side of the glove along the contra-lateral seam 51. A first pad of Velcro® (not shown) is sewn onto the strap at its free end, and a second pad of Velcro® 62, which receives the first pad, is sewn to the dorsal portion near the lateral seam 50. The user can adjust the fit of the glove by pulling on the strap until the glove is snug on the hand, and then the user fastens the first Velcro® pad to the second pad 62.

The manufacture of the second embodiment is identical to the first embodiment, except for the addition of a step to sew the thumb portion 46 to the dorsal portion 32 along the contra-lateral seam 51 and a step to sew the strap 60 and second Velcro® pad 62 to the dorsal portion.

Two embodiments of the present puncture-resistant gloves have been described. A person skilled in the art, however, will recognize that many other embodiments are possible, including variations of the embodiments presented. For this reason, the scope of the invention is not to be determined from the description of the embodiment, but must instead be determined solely from the claims that follow.

I claim:

1. A puncture-resistant glove for protecting a hand from needles and sharp objects, the hand having a palmar side and a dorsal side, and the glove comprising:

a palmar portion designed to extend over the palmar side of the hand, the palmar portion being made of a puncture-resistant material, wherein the puncture-resistant material comprises a plurality of layers of tightly woven base fabric having a density in excess of 80 threads per inch in at least the warp and fill directions and having warp yarn cover of at least 100% at the fill pick; and a dorsal portion designed to extend over at least part of the dorsal side of the hand, the dorsal portion being sewn to the palmar portion; and a plurality of seams connecting the palmar portion to the dorsal portion where in the seams connecting the palmar portion and the dorsal portion lie on a dorsal side of the glove.

2. The puncture-resistant glove of claim 1 wherein the plurality of seams comprises a lateral seam, a contra-lateral seam, a finger tip seam and a thumb seam.

3. The puncture-resistant glove of claim 1 wherein the dorsal portion is made of a stretchable material.

4. The puncture-resistant glove of claim 3 wherein a shirred elastic band is sewn into the dorsal portion of the glove.

5. The puncture-resistant glove of claim 1 wherein the dorsal portion is made of a punctune-resistant material.

6. The puncture-resistant glove of claim 5 further comprising an adjustment strap positioned across the dorsal portion of the glove.

7. The puncture-resistant glove of claim 1 wherein the palmar portion wraps around a side of a palm, a side of the little finger, and a tip of each finger.

8. The puncture-resistant glove of claim 1 wherein the yarn used in the base fabric is selected from the group consisting of para-aramids, high-density polyethylenes, and liquid crystal polymers.

9. The puncture-resistant glove of claim 1 further comprising an elastic knit wrist sewn to the palmar and dorsal portions of the glove at a wrist.

10. A puncture-resistant glove for protecting a hand from needles and sharp objects, the hand having a palmar side and a dorsal side, and the glove made by a process comprising:

cutting a pattern of a palmar portion of the glove from a puncture-resistant material, the palmar portion extending over the palmar side of the hand, and the puncture-resistant material comprising a plurality of layers of tightly woven base fabric having a density in excess of 80 threads per inch in at least the warp and fill directions and having warp yarn cover of at least 100% at the fill pick;

cutting a pattern of a dorsal portion of the glove, the dorsal portion extending over at least part of the dorsal side of the hand; and sewing the patterns of the palmar and dorsal portions together along a plurality of seams connecting the palmar portion to the dorsal portion, wherein the seams lie along the dorsal side of the glove.

11. The puncture-resistant glove of claim 10 wherein sewing the patterns of the palmar and dorsal portions together comprises sewing the palmar and dorsal portions together along a lateral seam, a contra lateral seam, a finger tip seam and a thumb seam.

12. The puncture-resistant glove of claim 10 made by a process further comprising sewing finger tip portions of the palmar pattern to the dorsal side of the respective fingers of the pattern of the palmar portion.

13. The puncture-resistant glove of claim 10 wherein sewing the palmar portion and the dorsal portion together comprises sewing using a number 18 needle.

14. A pattern for a palmar portion of a puncture-resistant glove, the glove having a palmar side and a dorsal side, the pattern comprising:

a shaped sheet of puncture-resistant material, wherein a dimension of the piece of material is designed such that the palmar portion of the glove will wrap around a side of a palm and a side of the little finger and be sewn to a dorsal portion of the glove along seams located on the dorsal side of the glove.

15. The pattern of claim 14 wherein the puncture-resistant material comprises a plurality of layers of tightly woven base fabric having a density in excess of 80 threads per inch in at least the warp and fill directions and having warp yarn cover of at least 100% at the fill pick.

* * * * *